US008109836B1

(12) United States Patent
Probst

(10) Patent No.: US 8,109,836 B1
(45) Date of Patent: Feb. 7, 2012

(54) INTERCHANGEABLE BILLIARD CUE TIP ASSEMBLY AND BILLIARD CUE UTILIZING SAME

(76) Inventor: Frederick E. Probst, Santa Fe, NM (US)

( * ) Notice: Subject to any disclaimer, the term of this patent is extended or adjusted under 35 U.S.C. 154(b) by 0 days.

(21) Appl. No.: 13/136,742

(22) Filed: Aug. 9, 2011

Related U.S. Application Data

(63) Continuation-in-part of application No. 12/586,434, filed on Sep. 22, 2009, now abandoned.

(51) Int. Cl.
*A63D 15/02* (2006.01)

(52) U.S. Cl. ..... 473/49

(58) Field of Classification Search ..... 473/44–51
See application file for complete search history.

(56) References Cited

U.S. PATENT DOCUMENTS

| | | | | | |
|---|---|---|---|---|---|
| 1,605,240 | A * | 11/1926 | Johnson | 473/49 |
| 2,245,655 | A * | 6/1941 | Dukes | 473/49 |
| 2,544,970 | A * | 3/1951 | Watson | 473/49 |
| 3,204,961 | A * | 9/1965 | Salamone | 473/49 |
| 3,226,119 | A * | 12/1965 | Foy | 473/49 |
| 3,381,960 | A * | 5/1968 | Reinhart | 473/51 |
| 3,554,544 | A * | 1/1971 | Wodarczyk | 473/49 |
| 5,462,490 | A * | 10/1995 | Donwen | 473/49 |
| 5,545,093 | A * | 8/1996 | Contestabile et al. | 473/36 |
| 5,782,693 | A * | 7/1998 | Jordan et al. | 473/48 |
| 6,398,660 | B1 * | 6/2002 | Probst et al. | 473/44 |
| 6,890,264 | B2 * | 5/2005 | Verona | 473/49 |
| 7,040,996 | B2 * | 5/2006 | Grandin | 473/46 |
| 7,520,817 | B2 * | 4/2009 | Sullivan | 473/49 |
| 2001/0046903 | A1 * | 11/2001 | Andrews | 473/44 |
| 2004/0082397 | A1 * | 4/2004 | Verona | 473/49 |
| 2006/0229135 | A1 * | 10/2006 | Mekosh | 473/44 |
| 2007/0281795 | A1 * | 12/2007 | Chang | 473/49 |
| 2008/0026860 | A1 * | 1/2008 | Titus et al. | 473/44 |
| 2008/0119297 | A1 * | 5/2008 | Costain | 473/44 |
| 2008/0318700 | A1 * | 12/2008 | Chang | 473/49 |
| 2009/0143156 | A1 * | 6/2009 | Schulze | 473/46 |

* cited by examiner

*Primary Examiner* — Mark Graham
(74) *Attorney, Agent, or Firm* — Daniel Robbins

(57) ABSTRACT

A billiard cue has a changeable cue tip/ferrule assembly wherein the ferrule has a conical projection fitting snugly into a congruent receptacle in a fixed tenon of the cue. Vibration of the ferrule is limited by being locked to the rigid cue. The configuration is also useful in establishing a concurrent center line of the cue stick and changeable cue tip assembly. The ferrule's cone has a hollow surface whose axis is aligned with the ferrule's longitudinal axis. The invention teaches that the cue, with the ferrule attached, may now be rotated in a lathe with the ferrule's cone's hollow surface mating with a live center in the lathe tailstock. Thus the final tapering and finishing of the cue stick shaft is accomplished in the lathe with the axis of the ferrule's cone defining the cue stick/changeable cue tip mutual centerline.

11 Claims, 2 Drawing Sheets

℄

INTERCHANGEABLE BILLIARD CUE TIP ASSEMBLY AND BILLIARD CUE UTILIZING SAME

This application is a continuation-in-part of application Ser. No. 12/586,434 filed Sep. 22, 2009, now abandoned.

BACKGROUND OF THE INVENTION

1. Field of the Invention

This invention relates to billiard cue accessories, and in particular to an interchangeable cue tip assembly and billiard cue utilizing same.

2. Description Relative to the Prior Art

The capability of rapid and uncomplicated changing of a billiard cue tip during a game gives a player a choice of interactions between the cue tip and a cue ball during a billiard stroke. For an off center shot, the friction between the cue tip and the cue ball affects the amount of "English" imparted to the cue ball, and hence its spin and trajectory over the table. The surface of cue tip's hardness and its friction characteristics are accordingly of great importance in determining the parameters of such billiard shots. The ability to quickly change cue tips, allowing a player to select the optimum cue tip for the shot, is a valuable option during the game.

U.S. Pat. No. 1,605,240 discloses a split sleeve that fits over the tip end of a standard cue stick and is fitted with a specifically chosen tip at the end of the sleeve. The sleeve is secured to the cue shaft by means of a circumferential ring that presses the sleeve against the shaft. U.S. Pat. No. 6,890,264 discloses a cylindrical chamber having a selected tip secured to one end of the chamber that fits over the tip end of a standard cue, and is frictionally fastened to the cue by means of a single O-ring fitted into a groove in the chamber inner wall. U.S. Patent Application Publication, US 2007/0281795 A1 discloses a conventional cue having an integral tenon at the shaft end and a slip on ferrule having an associated cue tip wherein the ferrule slides over the tenon and secured to the tenon by means of an elastic surface adhering to the inner surface of the ferrule.

SUMMARY OF THE INVENTION

In the first two embodiments of the invention the cue stick of the invention comprises a tenon and a ferrule with the desired cue tip mounted at the end of the ferrule, where the ferrule slips over and is secured to the tenon by means of at least two O-rings circumferentially positioned in grooves in the surface of the tenon. The O-rings provide frictional forces between the ferrule inner surface and the tenon, holding the ferrule stably and securely in place during the billiard shot. One or more vents are provided in the ferrule to allow air entrapped between the O ring and the inner surfaces of the ferrule to escape as the ferrule is being slid over the tenon. The tenon may either be fabricated as the end segment of the cue shaft proper, or may be a separate structure mounted in, and extending from, a truncated portion of the shaft.

In a third embodiment, the ferrule is provided with additional means for anchoring the end of the ferrule, and attendantly, the cue tip itself to the rigid tenon. With the ferrule positioned on the tenon, the face of the ferrule contacting the tenon's free end has a conical projection thereon which fits snugly into a congruently shaped conical mating receptacle in the free end of the tenon. This stabilizes the end of the ferrule on which the cue tip is mounted by locking it to the end of the tenon, and to the rigid body of the cue stick. Hence, vibration of the ferrule due to compression and expansion of the O-rings is limited in affecting the cue tip glued to the ferrule face.

The third embodiment is also useful in the fabrication of the cue stick/changeable cue tip assembly. The cone extending into the cavity of the ferrule is a hollow conical shell having its apex aligned with the ferrule's longitudinal axis. With the ferrule of the third embodiment in place on the tenon, the conical projection on the ferrule fits snugly into the conical depression of the tenon, and this makes it is possible to precisely establish the longitudinal center line of the finished cue stick. This is important in machining and tapering the cue so that is completely symmetrical about the overall cue center line. The third embodiment teaches that the cue, with the ferrule attached, may now be rotated in a lathe with the conical hollow surface of the ferrule mating with a live center in the lathe tailstock. Thus the final tapering and finishing of the cue stick shaft is accomplished with the axial position of the conical projection of the ferrule defining the cue stick centerline.

DESCRIPTION OF THE PREFERRED EMBODIMENTS

Figure 1:
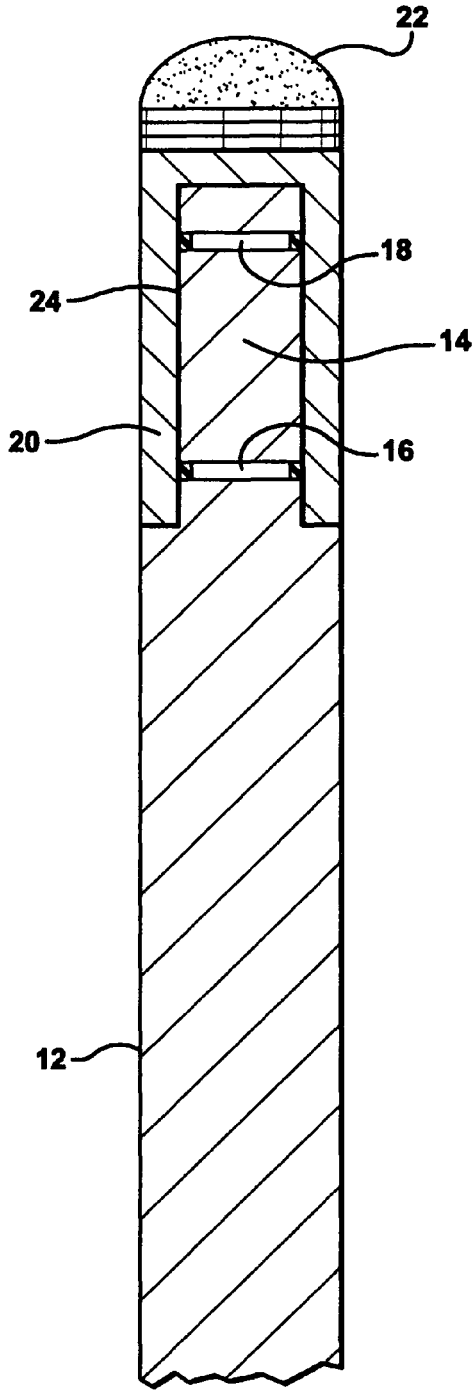
FIG. 1 is a cross sectional drawing of a first embodiment of the invention.

Referring to FIG. 1, a portion of a billiard cue, 12, terminates in an integral tenon, 14, formed by reducing the diameter of the end section of the cue, 12, or by securing a tenon, 14, into the end of the cue, 12. O rings, 16, 18 are mounted in grooves incised in the cylindrical surface of the tenon, 14, so that the outer circumferential edges of the O rings, 16, 18, protrude just above the cylindrical surface of the tenon, 14. A ferrule, 20, fitted with a cue tip, 22, is slid over the tenon, 14, so that the outer surfaces of the O rings, 16, 18 are slightly compressed while contacting the inner surface, 24, of ferrule 20. The two O rings, 16, 18 provide stability to the ferrule, 20, from rocking about any axis perpendicular to the tenon, 14 surface, as well as absorbing vibration set up in the cue, 12, when the cue tip, 22, strikes a cue ball. The two O rings, 16, 18, which may be fabricated from rubber or an elastrometric plastic, also provide adequate frictional force along the surface, 24, of the ferrule, 20, to keep the ferrule, 20, firmly in contact with the tenon, 14, while still allowing the ferrule, 20, to be manually slid off the cue, 12, and replaced when it is desired to use a different cue tip, 22. At least one vent, 38, is fabricated in the ferrule, 20, to allow entrapped air to escape the chamber formed by O ring, 18, and the inner surface walls of the ferrule, 20, as the ferrule, 20, is being positioned on the tenon, 14.

Figure 2:
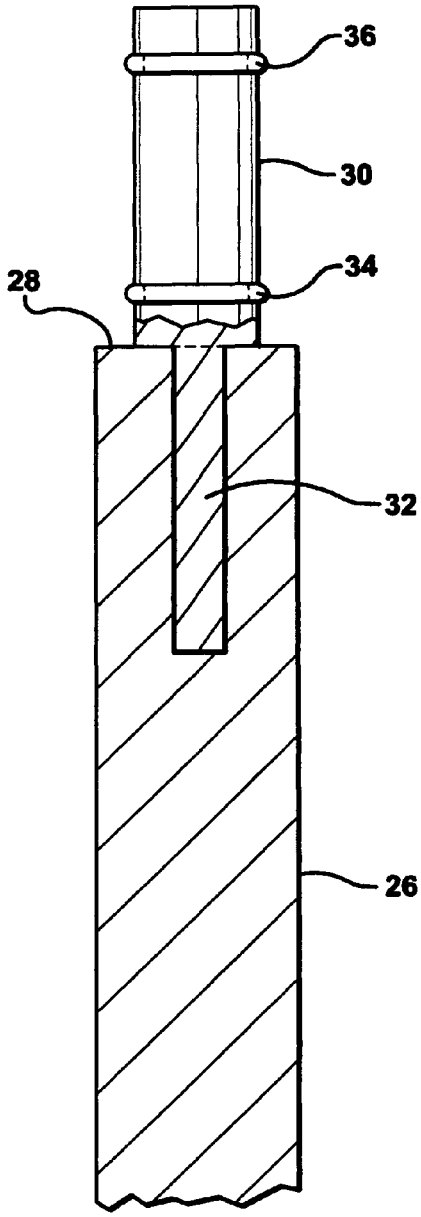
FIG. 2 is a cross sectional drawing of a second embodiment of the invention.

A second embodiment of the invention applies to the retrofit of a conventional cue so a replaceable ferrule and its desired cue tip assembly may be accommodated. In a conventional cue, the ferrule is permanently attached to the cue's shaft, and cannot be conveniently removed. Referring to FIG. 2, to follow the practice of the invention, the end of the cue shaft, 26, containing its ferrule is cut off, leaving a truncated end, 28, of the cue shaft, 26. A hole is bored in cue shaft, 26, at the truncated end, 28, and a fabricated tenon, 30, including a mounting pin, 32, is secured in the cue shaft, 26, by gluing the mounting pin, 32, in the bored hole. The tenon, 30, has circumferential grooves in its surface, in which are fitted O rings, 34, 36. The tenon, 30, and pin, 32, are preferably fabricated from aluminum, and while the tenon, 30, in the preferred embodiment, has two grooves, and associated O rings, the tenon, 30, may be provided with more than two grooves and O rings. A replaceable ferrule and cue tip fit over the tenon, 30, in the manner identical to that shown in FIG. 1.

Figure 4:
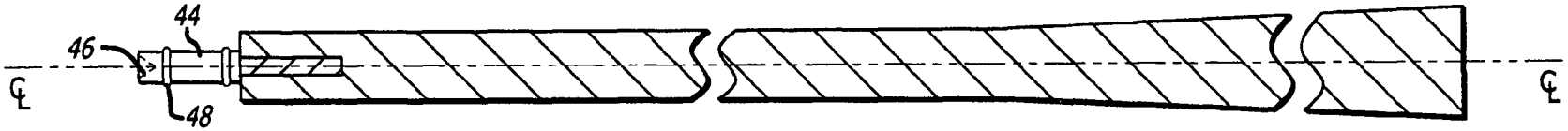
FIGS. 3-6 are cross sectional drawings of a third embodiment of the invention.
Figure 3:
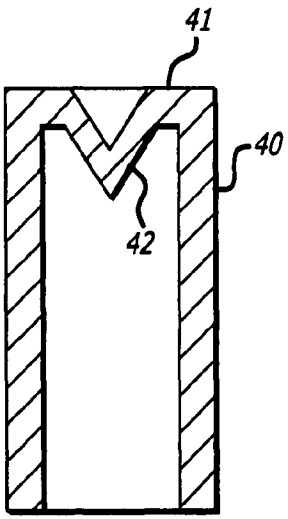
Figure 5:
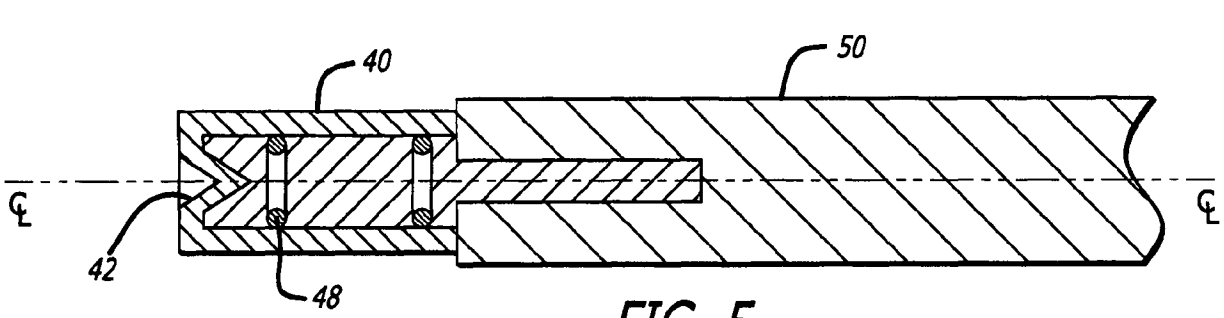
Figure 6:
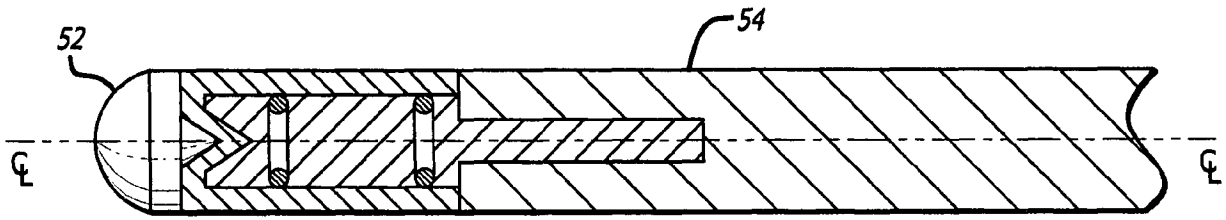

In the third embodiment of the invention, and referring to FIG. 3, a modified ferrule, 40, has a hollow cone, 42, embedded in the face of the ferrule, 40, to which the cue tip, 52, will be affixed by gluing to ferrule face, 41. In FIG. 4, the tenon, 44, has a conical depression, 46, bored on its centerline, congruent with the outer surface of the hollow cone, 42. Shown in FIG. 5, the ferrule, 40, is mounted on the tenon, 44, so that the outer surface of the cone, 42, mates with the conical depression, 46, of the tenon, 44. This locks the end of the ferrule, 40, to the tenon, 44, minimizing transmission to the cue tip, 22, of vibration induced in the ferrule, 40 during the stroke against the cue ball.

The hollow cone, 42, serves another useful function. It is essential that the longitudinally symmetrical components of the assembled cue, i.e., ferrule, 40, and truncated shaft, 50, be mutually aligned along the cue center line prior to the shaft 50, being finally shaped with the desired cue taper. With the ferrule, 40, mounted on the tenon, 44, the cue stick may be inserted between the tailstock and spindle of a lathe, wherein the cone 42, mating with a lathe live center, will determine the direction of the center line of the cue. As the finished cue stick, 54, surface is processed in the rotating lathe, the entire cue stick, 54, including ferrule, 40, will be longitudinally symmetrical with respect to the cue's centerline, an important requirement for controllable billiard shots.

The invention has been described in terms of preferred embodiments, but it will be understood that modifications and variations can be effected within the spirit and scope of the invention.

What is claimed is:

1. A billiard cue comprising a shaft, said cue comprising:

a) a tenon extending from said shaft, said tenon further comprising, b) at least two O rings circumferentially mounted on said tenon, c) a manually changeable ferrule having a cue tip mounted thereon, said ferrule positioned on said tenon, said ferrule further having a cylindrical inner surface whereby said at least two O rings provide frictional contact between said surface and said tenon so that said ferrule is substantially secured to said tenon, d) said ferrule further comprising at least one vent hole through said surface, whereby air entrapped interiorly in said ferrule is vented, e) a longitudinally projecting member connected to the end face of said ferrule, said projecting member extending into the interior cavity of said ferrule, and f) a longitudinally oriented void extending into said tenon, said void originating at the free end face of said tenon, said void being geometrically congruent with said longitudinally projecting member of said ferrule, whereby when said ferrule is positioned on said tenon, said projecting member is in intimate engagement with said void.

2. The billiard cue to claim 1 wherein said projecting member is conical in shape.

3. The billiard cue to claim 1 wherein said void is conical in shape.

4. The billiard cue of claim 1 wherein said at least two O rings are fabricated from rubber.

5. The billiard cue of claim 1 wherein said at least two O rings are fabricated from elastrometric plastic.

6. A retrofitted billiard cue having a truncated shaft, said cue comprising:

a) a separate tenon mounted in said truncated shaft, said tenon further comprising, b) at least two O rings circumferentially mounted on said tenon, c) a manually changeable ferrule positioned on said tenon, said ferrule having a cue tip mounted thereon, said ferrule further having a cylindrical inner surface, whereby said at least two O rings provide frictional contact between said surface and said tenon so that said ferrule is substantially secured to said tenon, d) said surface having at least one vent hole there through, e) a longitudinally projecting member connected to the end face of said ferrule, said projecting member extending into the interior cavity of said ferrule, and f) a longitudinally oriented void extending into said tenon, said void originating at the free end face of said tenon, said void being geometrically congruent with said longitudinally projecting member of said ferrule, whereby when said ferrule is positioned on said tenon, said projecting member is in intimate engagement with said void.

7. The billiard cue to claim 6 wherein said projecting member is conical in shape.

8. The billiard cue to claim 6 wherein said void is conical in shape.

9. The billiard cue of claim 6 wherein said at least two O rings are fabricated from rubber.

10. The billiard cue of claim 6 wherein said at least two O rings are fabricated from elastrometric plastic.

11. A method of retrofitting a billiard cue comprising the steps:

a) cutting off a first tenon and a first ferrule of said cue to provide a truncated shaft, b) securing a second tenon into said truncated shaft, said second tenon extending from said truncated shaft, said second tenon further comprising at least two O rings circumferentially mounted on said second tenon, c) positioning a second ferrule onto said second tenon, said second ferrule having a cylindrical inner surface having a vent hole therein, d) providing in said second ferrule a hollow conically shaped longitudinally projecting member connected to the end face of said second ferrule, said projecting member extending into the interior cavity of said second ferrule, e) providing in said second tenon a conically shaped longitudinally oriented void extending into said second tenon, said void originating at the free end face of said second tenon, said void being geometrically congruent with said hollow conically shaped longitudinally projecting member of said second ferrule, whereby when said second ferrule is positioned on said second tenon, said projecting member is in intimate engagement with said void, f) mounting said billiard cue in a lathe, wherein the hollow surface of said hollow conically shaped longitudinally projecting member is mated with the live center of the tailstock of the lathe, the butt end of said billiard cue being mounted in the headstock of the lathe, and g) operating the lathe to shape the lateral surface of said billiard cue, and h) removing said billiard cue from the lathe and adhesively affixing a cue tip to said second ferrule.

* * * * *